US012220023B2

(12) United States Patent
Yen

(10) Patent No.: US 12,220,023 B2
(45) Date of Patent: Feb. 11, 2025

(54) EASY-TO-ASSEMBLE BUCKLE

(71) Applicant: Ying-Chuan Yen, Changhua County (TW)

(72) Inventor: Ying-Chuan Yen, Changhua County (TW)

( * ) Notice: Subject to any disclaimer, the term of this patent is extended or adjusted under 35 U.S.C. 154(b) by 0 days.

(21) Appl. No.: 18/221,467

(22) Filed: Jul. 13, 2023

(65) Prior Publication Data

US 2024/0365935 A1 Nov. 7, 2024

(30) Foreign Application Priority Data

May 6, 2023 (CN) ..... 202310509676.2
May 6, 2023 (CN) ..... 202321083252.6

(51) Int. Cl.
*A44B 11/25* (2006.01)

(52) U.S. Cl.
CPC ..... *A44B 11/2519* (2013.01); *A44B 11/2592* (2013.01); *Y10T 24/45702* (2015.01)

(58) Field of Classification Search
CPC ..... Y10T 24/45785; Y10T 24/45628; Y10T 24/45681; Y10T 24/45696; Y10T 24/45602; Y10T 24/45623; Y10T 24/45675; Y10T 24/45702; Y10T 24/45775; Y10T 24/45791; A44B 11/266; A44B 11/2592; A44B 11/2519
See application file for complete search history.

(56) References Cited

U.S. PATENT DOCUMENTS 1,459,674 A * 6/1923 Jabner ..... A44C 5/2052 24/643
2,847,748 A * 8/1958 Robinton ..... A44B 11/2519 24/313
3,090,092 A * 5/1963 Szemplak ..... A44B 11/2519 24/648
5,355,562 A * 10/1994 Matoba ..... A44B 11/266 24/615
10,617,180 B1 * 4/2020 Yen ..... A44B 11/06
2018/0289113 A1 * 10/2018 Chu ..... A44B 11/266

* cited by examiner

*Primary Examiner* — Jason W San
*Assistant Examiner* — Michael S Lee
(74) *Attorney, Agent, or Firm* — Demian K. Jackson; Jackson IPG PLLC

(57) ABSTRACT

An easy-to-assemble buckle includes a male buckle and a female buckle assembly. The female buckle assembly comprises a female buckle, a fastener, a button and a back cover. The fastener has a spring arm on its lateral side. The button is connected with the spring arm. The male buckle has an insert pin. The button is configured with a spring arm slot with its openings facing frontward and inward. The fastener is inserted from the front end of the female buckle and is locked and fixed with the female buckle through a buckling mechanism. The spring arm is inserted into the spring arm slot is pressed against the button. The fastener is configured with a through insert hole extending from the front to the back. The insert pin of the male buckle goes through the insert hole and is inserted into the female buckle to connect with the button.

5 Claims, 3 Drawing Sheets

EASY-TO-ASSEMBLE BUCKLE

BACKGROUND OF INVENTION

1. Field of the Invention

The present invention relates generally to the technical field of buckle components, and more particularly to a buckle to fix straps.

2. Description of Related Art

Buckles are widely used in apparels, cases and bags, sport equipment, pet supplies etc. for fixing straps. A buckle usually comprises a male buckle and a female buckle assembly. The male buckle is inserted into the female buckle assembly for fixation. Conventional buckles are normally made of plastic materials, posing a high risk of breakage due to the low structural strength. To enhance the structural strength of the buckle, metal materials such as zinc alloy are used to make the buckle. However, currently, when producing such buckles, the components such as female buckle, back cover, and buttons need to undergo surface processing (such as electroplating) before they are assembled. This makes the production quite complicated. The inconvenient assembly and difficult operation lead to low production efficiency.

SUMMARY OF THE INVENTION

The present invention aims to solve the technical problem of the prior art and to provide a buckle with simpler structure, higher assembly efficiency and more convenient operation.

To overcome the above technical problem, the present invention adopted the following technical solution: an easy-to-assemble buckle, comprising a male buckle and a female buckle assembly, said female buckle assembly comprising a female buckle, a fastener, a button and a back cover, said female buckle, button and back cover being made of metal, said fastener being made of plastic, said button being mounted inside the female buckle through a fixing column so that it can be pressed toward the inside of the female buckle; said back cover and fastener being respectively assembled and fixed with the female buckle, said fastener having a spring arm on its lateral side, said button being connected with the spring arm; said male buckle having an insert pin, when the insert pin is inserted into the female buckle assembly, the insert pin is locked by the button, so that the male buckle is coupled and fixed with the female buckle assembly, characterized in that: the button is configured with a spring arm slot with its openings facing frontward and inward, said fastener is inserted from the front end of the female buckle and is locked and fixed with the female buckle through a buckling mechanism, said spring arm is inserted into the spring arm slot and is pressed against the button; said fastener is configured with a through insert hole extending from front to back, the insert pin of the male buckle goes through the insert hole and is inserted into the female buckle to be connected with the button.

Further, said buckling mechanism comprises a fixer configured on the back side of the fastener and a buckling position configured on the back cover. After the fastener is inserted into the female buckle, it is fixed by locking the fixer with the buckling position.

Further, said back cover is sleeved onto the fixing column from the bottom of the button, and a spin rivet is used to fix the back cover with the fixing column, so that the button is mounted inside the female buckle.

Further, two buttons are provided, said two buttons are separated and independent, and are respectively and symmetrically installed on the female buckle through a fixing column, with a small part exposed on the left and right sides of the female buckle. Two spring arms are provided to match the two buttons, the two spring arms being symmetrically configured on the left and right sides of the fastener and form an integral body with the fastener.

Further, the fastener is configured with a guide bar extending from front to back, the guide bar is extended into the insert hole. The insert pin of the male buckle is configured with a guide slot on the side facing the guide bar. When inserting the insert pin into the female buckle, the insertion of the insert pin can be guided by inserting the guide bar into the guide slot, so as to avoid unaligned insertion of the insert pin.

Preferably, said male buckle, female buckle, button, and back cover are made of zinc alloy, aluminum alloy or stainless steel. Of course, the above components can be made of any material as needed.

In production, the female buckle can be assembled with the two buttons and the back cover before electroplating. After electroplating, the metal assembly can be inserted into the plastic fastener to complete the whole assembly operation of the female buckle assembly. The easy operation and simplified assembly can greatly enhance production efficiency. Reduced components can also ensure better reliability and lower production cost of the buckle.

Figure 1:
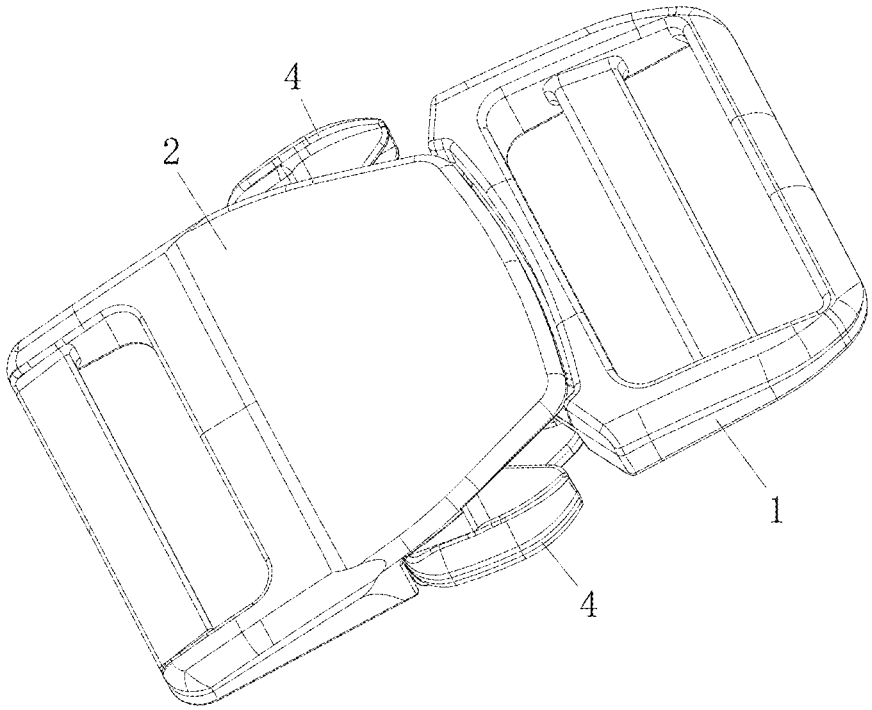
FIG. 1 is a perspective view of the present invention.
Figure 2:
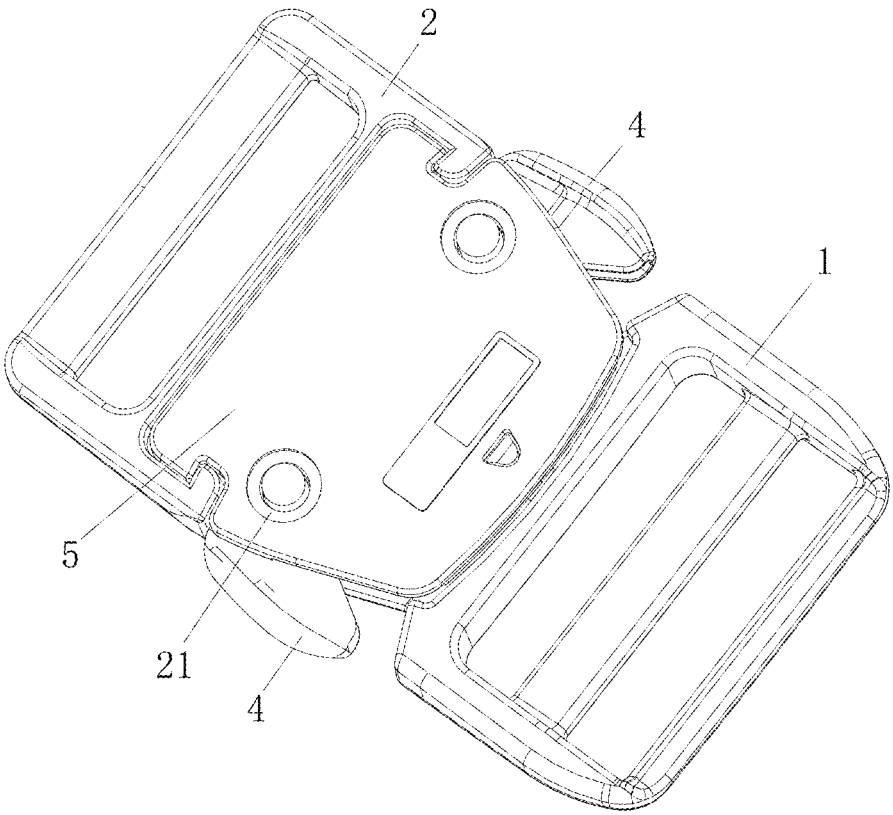
FIG. 2 is a perspective view of the present invention from a different angle.
Figure 3:
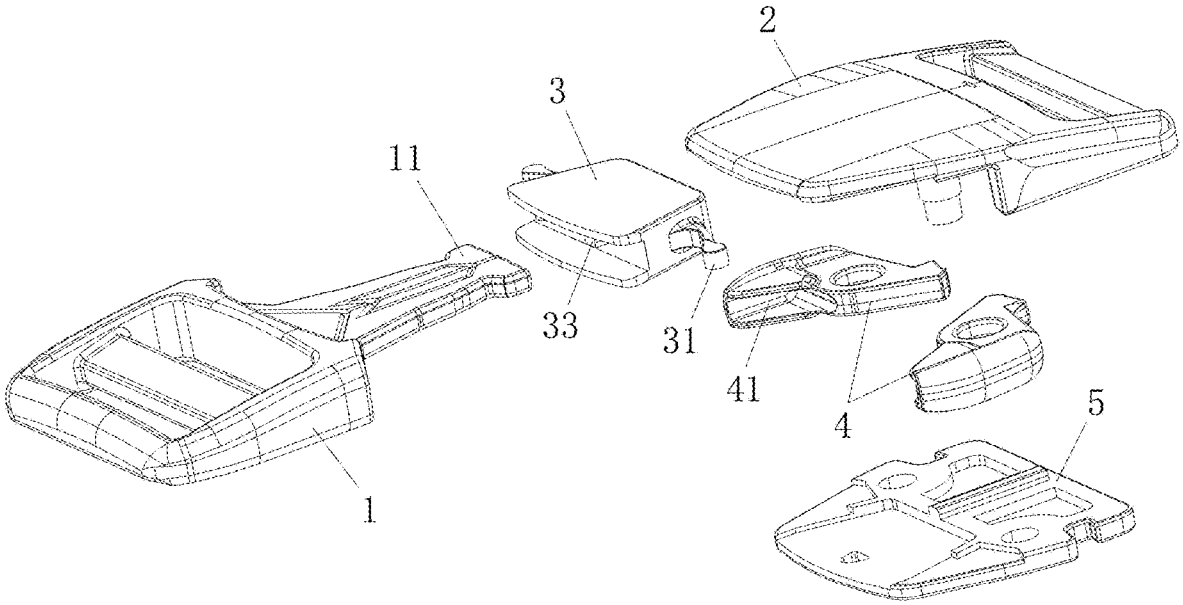
FIG. 3 is an exploded view of the present invention.
Figure 4:
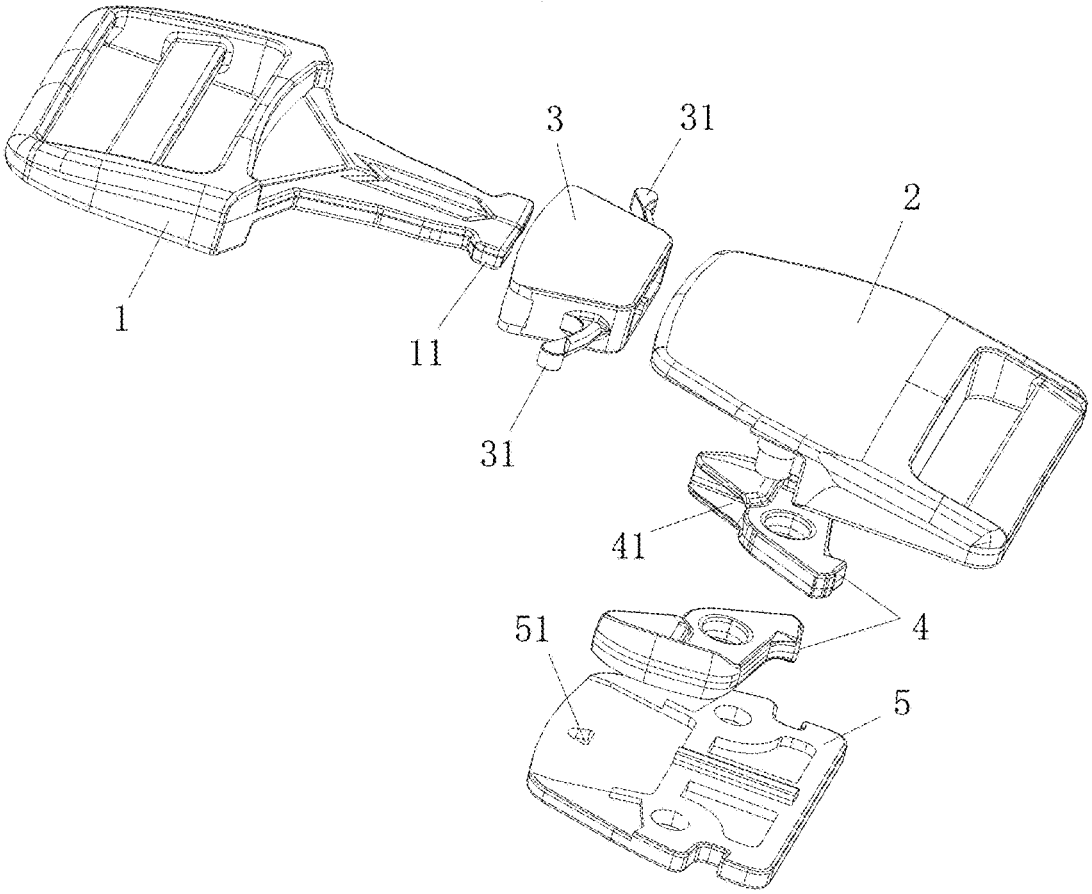
FIG. 4 is an exploded view of the present invention from a different angle.
Figure 5:
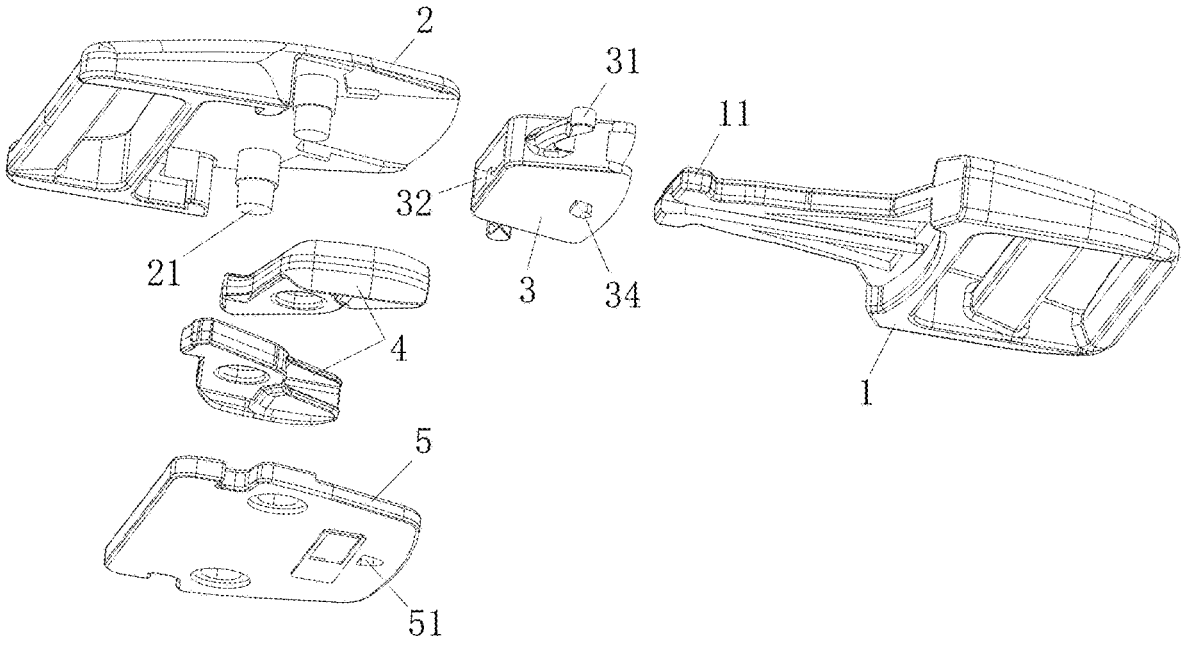
FIG. 5 is an exploded view of the present invention from a third angle.

In the drawings, 1 is male buckle, 11 is insert pin, 2 is female buckle, 21 is fixing column, 3 is fastener, 31 is spring arm, 32 is insert hole, 33 is guide bar, 34 is fixer, 4 is button, 41 is spring arm slot, 5 is back cover, 51 is buckling position.

DETAILED DESCRIPTION OF THE INVENTION

Figure 6:
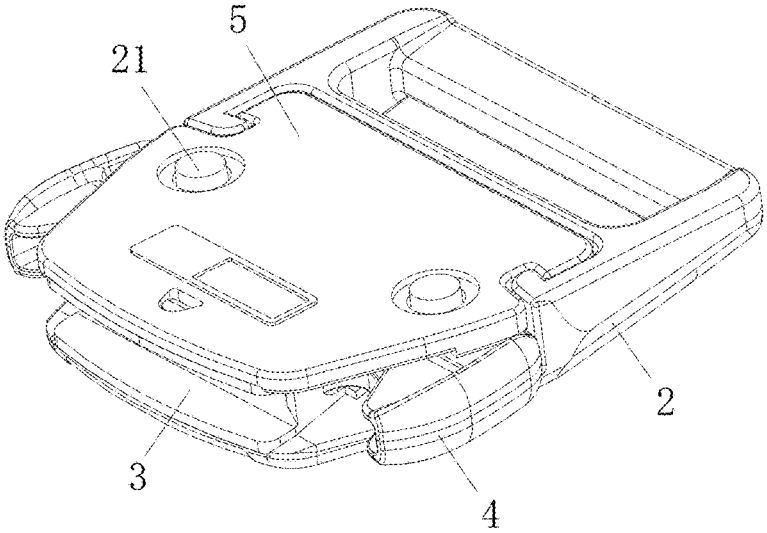
FIG. 6 is an overall structural view of the female buckle assembly.

Referring to FIG. 1 and FIG. 6, in the present embodiment, the easy-to-assemble buckle comprises a male buckle 1 and a female buckle assembly. The female buckle assembly comprises a female buckle 2, a fastener 3, a button 4, and a back cover 5. The female buckle 2, button 3, and back cover 5 are made of metal, such as zinc alloy. The fastener 3 is made of plastic. The button 4 is mounted inside the female buckle 2 through a fixing column 21 so that it can be pressed toward the inside of the female buckle 2. The back cover 5 and the fastener 3 are respectively assembled and fixed with the female buckle 2. The fastener 3 has a spring arm 31 on its lateral side. The button 4 is connected with the spring arm 31. The male buckle 1 has an insert pin 11. When the insert pin 11 is inserted into the female buckle assembly, the insert pin 11 is locked by the button 4 so that the male buckle 1 is coupled and fixed with the female buckle assembly. When the button 4 is pressed, the male buckle 1 can be released, so that the male buckle 1 can be pulled out. The button 4 is configured with a spring arm slot 41 with its openings facing frontward and inward. The fastener 3 is inserted from the front end of the female buckle 2 and is locked and fixed with the female buckle 2 through a buckling mechanism. The spring arm 31 is inserted into the spring arm slot 41 and is pressed against the button 4. The fastener 3 is configured with a through insert hole 32 extending from front to back. The insert pin 11 of the male buckle 1 goes through the insert hole 32 and is inserted into the female buckle 2 to be connected with the button 4.

The buckling mechanism comprises a fixer 34 configured on the back side of the fastener 3 and a buckling position 51 configured on the back cover 5. After the fastener 3 is inserted into the female buckle 2, it is fixed by locking the fixer 34 with the buckling position 51.

The back cover 5 is sleeved onto the fixing column 21 from the bottom of the button 4, and a spin rivet is used to fix the back cover 5 with the fixing column 21, so that the button 4 is mounted inside the female buckle 2.

Two buttons 4 are provided. The two buttons 4 are separated and independent, and are respectively and symmetrically installed on the female buckle 2 through a fixing column 21, with a small part exposed on the left and right sides of the female buckle 2. Two spring arms 31 are provided to match the two buttons 4, the two spring arms 31 being symmetrically configured on the left and right sides of the fastener 3 and form an integral body with the fastener 3.

The fastener 3 is configured with a guide bar 33 extending from front to back. The guide bar 33 is extended into the insert hole 32. The insert pin 11 of the male buckle 1 is configured with a guide slot on the side facing the guide bar 33. When inserting the insert pin 11 into the female buckle 2, the insertion of the insert pin 11 can be guided by inserting the guide bar 33 into the guide slot, so as to avoid unaligned insertion of the insert pin 11.

During production, the two buttons 4 are firstly installed on the fixing column 21, and then the back cover 5 is also installed on the fixing column 21, so that the back cover 5 covers the button 4 on the bottom. Then, the combination of the female buckle 2, the buttons 4, and the back cover 2 undergo electroplating. After electroplating, the combination is inserted into the fastener 3 to complete the assembly of an automatically locking buckle structure, i.e., the female buckle assembly.

After the male buckle 1 is inserted into the female buckle 2, it will squeeze the button 4 till it is caught inside the buckling position of the male buckle 1. Due to the elastic force of the spring arm 31, the button 4 will be caught by the buckling positions on the male buckle 1, thus forming a locking structure. To open the buckle, press the buttons 4 on both sides, and the buckling position of the button 4 will be released to release the male buckle 1. The male buckle can be detached from the female buckle assembly. When the spring arm 31 of the fastener 3 is coupled with the button 4, working with the insert pin 11 of the male buckle 1, a buckling mechanism is formed, capable of repeated pressing and releasing.

The structure of the present invention is described in detail using the above preferred embodiment. However, the preferred embodiment is not intending to limit the scope of the invention. All equivalent variations or modifications based on the present patent application shall be covered by the scope of the invention.

The invention claimed is:

1. An easy-to-assemble buckle, comprising a male buckle and a female buckle assembly, said female buckle assembly comprising a female buckle, a fastener, a button and a back cover, said female buckle, button and back cover being made of metal, said fastener being made of plastic, said button being mounted inside the female buckle with a fixing column therethrough so that it can be pressed toward the inside of the female buckle, said back cover and fastener being respectively assembled and fixed with the female buckle, said fastener having a spring arm on its lateral side, said button being connected with the spring arm; said male buckle having an insert pin, when the insert pin is inserted into the female buckle assembly, it is locked by the button, so that the male buckle is coupled with the female buckle assembly, characterized in that: the button is configured with a spring arm slot with its openings facing frontward and inward, the fastener is inserted from the front end of the female buckle and is locked and fixed with the female buckle through a buckling mechanism, the spring arm is inserted into the spring arm slot and is pressed against the button; the fastener is configured with a through insert hole extending from front to back, the insert pin of the male buckle goes through the insert hole and is inserted into the female buckle to be connected with the button, wherein the fastener is configured with a guide bar extending from front to back, the guide bar is extended into the insert hole; the insert pin of the male buckle is configured with a guide slot on the side facing the guide bar, when inserting the insert pin into the female buckle, the insertion of the insert pin can be guided by inserting the guide bar into the guide slot.

2. The easy-to-assemble buckle defined in claim 1, characterized in that: said buckling mechanism comprises a fixer configured on the back side of the fastener and a buckling position configured on the back cover, and the fastener is inserted into the female buckle and is fixed by fastening its fixer with the buckling position.

3. The easy-to-assemble buckle defined in claim 1, characterized in that: said back cover is sleeved onto the fixing column from the bottom of the button, and a spin rivet is used to fix the back cover with the fixing column, so that the button is mounted inside the female buckle.

4. The easy-to-assemble buckle defined in claim 1, characterized in that: two buttons are provided, said two buttons are separated and independent, and are respectively and symmetrically installed on the female buckle through a fixing column, with a small part exposed on the left and right sides of the female buckle; two spring arms are provided to match the two buttons, the two spring arms being symmetrically configured on the left and right sides of the fastener and form an integral body with the fastener.

5. The easy-to-assemble buckle defined in claim 1, characterized in that: said male buckle, female buckle, button and back cover are made of zinc alloy, aluminum alloy or stainless steel.

* * * * *